US006530443B1

(12) United States Patent
Tsuruta et al.

(10) Patent No.: US 6,530,443 B1
(45) Date of Patent: Mar. 11, 2003

(54) STRUCTURE OF ATTACHING HEAT INSULATOR

(75) Inventors: Yuichiro Tsuruta, Wako (JP); Yukio Kamo, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,561

(22) Filed: Sep. 1, 2000

(30) Foreign Application Priority Data

Sep. 3, 1999 (JP) ..... 11-250972

(51) Int. Cl.[7] ..... B60K 13/04
(52) U.S. Cl. ..... 180/89.2
(58) Field of Search ..... 180/89.2, 309; 60/298, 321, 322; 181/241

(56) References Cited

U.S. PATENT DOCUMENTS

| | | | | | |
|---|---|---|---|---|---|
| 3,237,716 | A | * | 3/1966 | Parsons | 181/72 |
| 3,863,445 | A | * | 2/1975 | Heath | 60/299 |
| 3,946,764 | A | * | 3/1976 | Hubbell, III | 138/148 |
| 3,963,087 | A | * | 6/1976 | Grosseau | 180/89.1 |
| 4,024,377 | A | | 5/1977 | Henke | 219/439 |
| 4,085,816 | A | | 4/1978 | Amagai et al. | 180/89.2 |
| 5,036,947 | A | * | 8/1991 | Metzger | 181/241 |
| 5,653,905 | A | | 8/1997 | McKinney | 219/400 |
| 5,900,173 | A | | 5/1999 | Robards, Jr. | 219/392 |
| 6,031,208 | A | | 2/2000 | Witt et al. | 219/407 |
| 6,230,488 | B1 | * | 5/2001 | Voss | 60/298 |

FOREIGN PATENT DOCUMENTS

| | | | | |
|---|---|---|---|---|
| DE | 3617486 A1 | * | 11/1987 | |
| JP | 0099420 | * | 7/1980 | 180/89.1 |
| JP | 355104515 A | * | 8/1980 | 60/322 |
| JP | 2-26045 B2 | | 3/1984 | |
| JP | 362268722 A | * | 11/1987 | |

* cited by examiner

*Primary Examiner*—Daniel G. DePumpo
*Assistant Examiner*—Daniel Yeagley
(74) *Attorney, Agent, or Firm*—Birch, Stewart, Kolasch & Birch, LLP

(57) ABSTRACT

A band-like member which is made to wrap on an outer periphery of an exhaust pipe is interposed between the exhaust pipe and a heat insulator covering the exhaust pipe. Both end portions of the band-like member in the length direction and attaching portions formed at a pair of edge portions along the length direction of the heat insulator oppose each other and overlap each other. These members are fastened together by a bolt and nut, which have interposed therebetween a collar to ensure proper separation of ends of the band-like member and heat insulator.

10 Claims, 8 Drawing Sheets

STRUCTURE OF ATTACHING HEAT INSULATOR

BACKGROUND OF THE INVENTION

1. Field of the Invention

The present invention relates to a structure for attaching a heat insulator to an exhaust pipe of a vehicle.

2. Background Art

It is known to attach a heat insulator to an exhaust pipe. For example, Japanese Patent Publication No. 26045/1990 discloses an exhaust pipe and heat insulator construction in which a stay is welded to the exhaust pipe, a band-like member is welded to an inner side of the heat insulator and the band-like member is fastened to the stay by a screw. Further, it is also known that a nut may be directly welded to an exhaust pipe in place of the stay, and a band-like member is directly fastened thereto by a screw.

According to the conventional examples, members to be attached to an exhaust pipe must be welded to both of the exhaust pipe and the heat insulator, or at least any members must be welded on the side of the exhaust pipe. Accordingly, the number of fabrication steps is increased, therefore, resulting in significant manufacturing costs. Further, in the case where the heat insulator is directly fastened to a nut on the exhaust pipe by the screw, an accuracy of a weld position is liable to deteriorate by thermal influence in welding the nut. Therefore, positioning of the heat insulator relative to the exhaust pipe becomes difficult and an assembly operation may be difficult. In addition, to facilitate attachment of the heat insulator, it is conceivable to constitute a screw hole on a side of the heat insulator; however, vibration noise is liable to occur since the exhaust pipe inherently constitutes a vibration source.

SUMMARY OF THE INVENTION

It is an object of the present invention to provide a structure of attaching a heat insulator dispensing with welding operation.

In order to solve the above-described problem, according to a first aspect of the present invention, there is provided a structure of attaching a heat insulator to an exhaust pipe. The structure includes a band-like member made to wrap on an outer periphery of the exhaust pipe and the heat insulator for covering the exhaust pipe from an outer side thereof. Both end portions in a length direction of the band-like member and a pair of edge portions of the heat insulator along a length direction of the exhaust pipe are simultaneously coupled to thereby attach the heat insulator to the exhaust pipe via the band-like member.

According to a second aspect of the present invention, there is provided the structure of attaching a heat insulator according to the first aspect, where attaching portions are integrally provided respectively to the pair of edge portions of the heat insulator along the length direction thereof. The attaching portions on a side of the heat insulator are made to overlap on outer sides of a pair of attaching portions provided at the both end portions in the length direction of the band-like member. The respective attaching portions on the side of the heat insulator and on a side of the band-like member are integrally coupled by a bolt and a nut in a state in which a collar is interposed between the attaching portions on the side of the band-like member.

According to the first aspect of the present invention, when the band-like member is firstly made to wrap on the outer periphery of the exhaust pipe, the heat insulator is further made to cover the band-like member from an outer side thereof, and both end portions in the length direction of the band-like member and the pair of edge portions of the heat insulator along the length direction of the exhaust pipe are made to overlap to thereby integrally couple with each other. Moreover, the band-like member is made to wrap and fixed onto a surrounding of the exhaust pipe and the heat insulator is coupled to the band-like member. Therefore, the heat insulator is attached to the exhaust pipe via the band-like member.

Therefore, welding attaching members to the heat insulator and the exhaust pipe as in the conventional structure is not required. The band-like member can be made separate from the heat insulator and the exhaust pipe until the attaching operation. Accordingly, the conventional welding process is eliminated, therefore, reducing the number of fabrication steps in assembling the heat insulator and the exhaust pipe. This results in enhanced fabrication performance and enables a reduction in manufacturing costs.

Moreover, by eliminating the welding operation, a deterioration in accuracy at the attaching portion caused by welding can be prevented. Moreover, according to the present invention the requirement of providing a screw hole in the heat insulator is eliminated; therefore, vibration as a result of the exhaust pipe does not occur.

According to the second aspect of the present invention, when the attaching portions are respectively provided at the both end portions in the length direction of the band-like member and the pair of edge portions of the heat insulator along the length direction of the exhaust pipe, the attaching members are made to overlap each other and fastened together by the bolt and the nut in a state in which the collar is interposed between the attaching portions on the side of the band-like member, thus, the heat insulator can easily be integrated to the exhaust pipe. In this case, by interposing the collar, the attaching portions can easily be attached even when there is deviation in accuracy of a dimension between the respective attaching portions.

Further scope of applicability of the present invention will become apparent from the detailed description given hereinafter. However, it should be understood that the detailed description and specific examples, while indicating preferred embodiments of the invention are given by way of illustration only, since various changes and modifications within the sprit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not imitative of the present invention, and wherein.

DETAILED DESCRIPTION OF THE PREFERRED EMBODIMENTS

Figure 1:
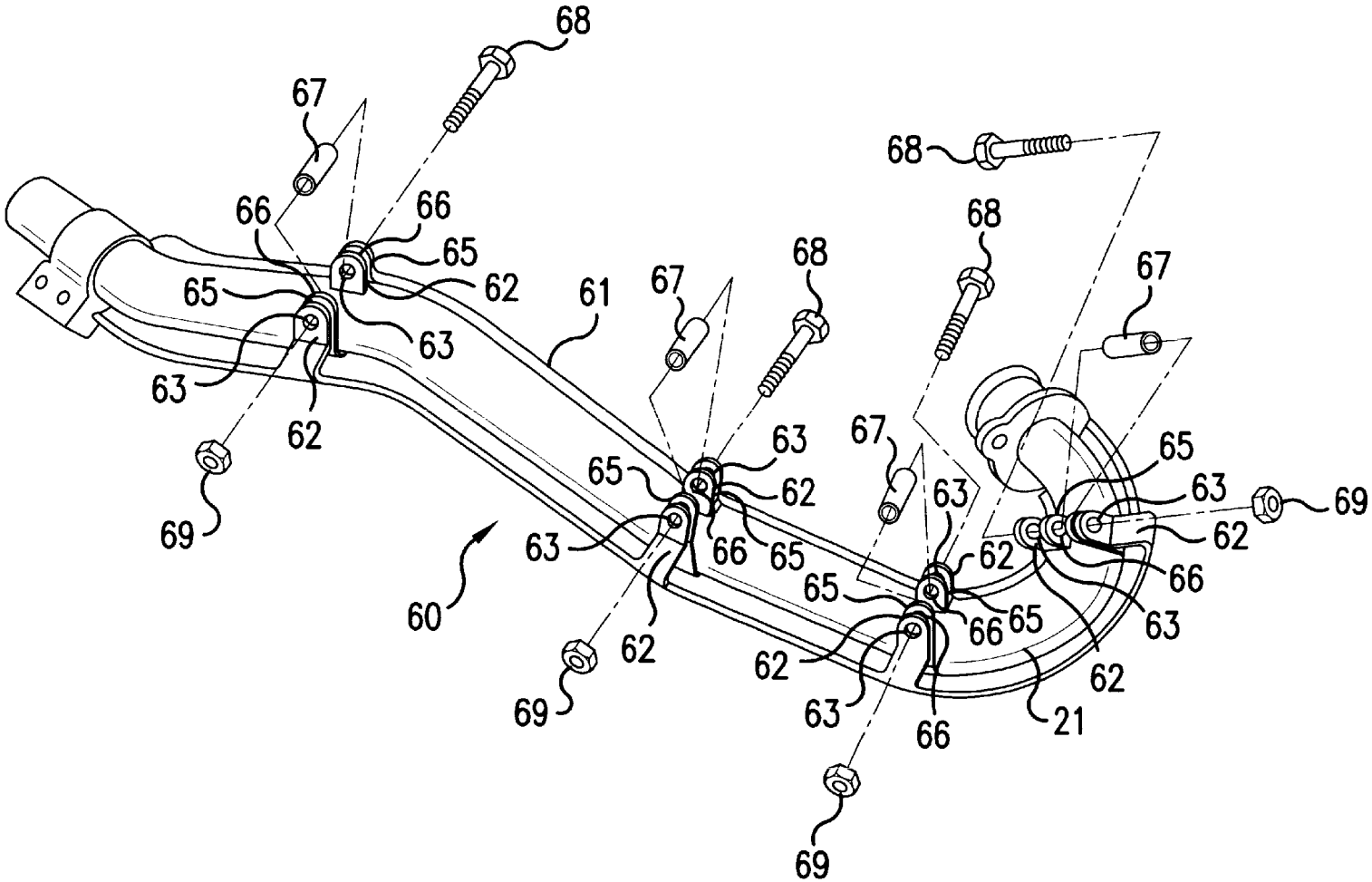
FIG. 1 is a perspective view of a heat insulator according to an embodiment of the present invention.

The present invention will hereinafter be described with reference to an embodiment shown in the drawings. The drawings refer to a four wheel vehicle, however the use of such a vehicle type is for illustrative purposes only, and should not be construed as limiting of the present invention. The present invention may be employed on various vehicle types.

Figure 2:
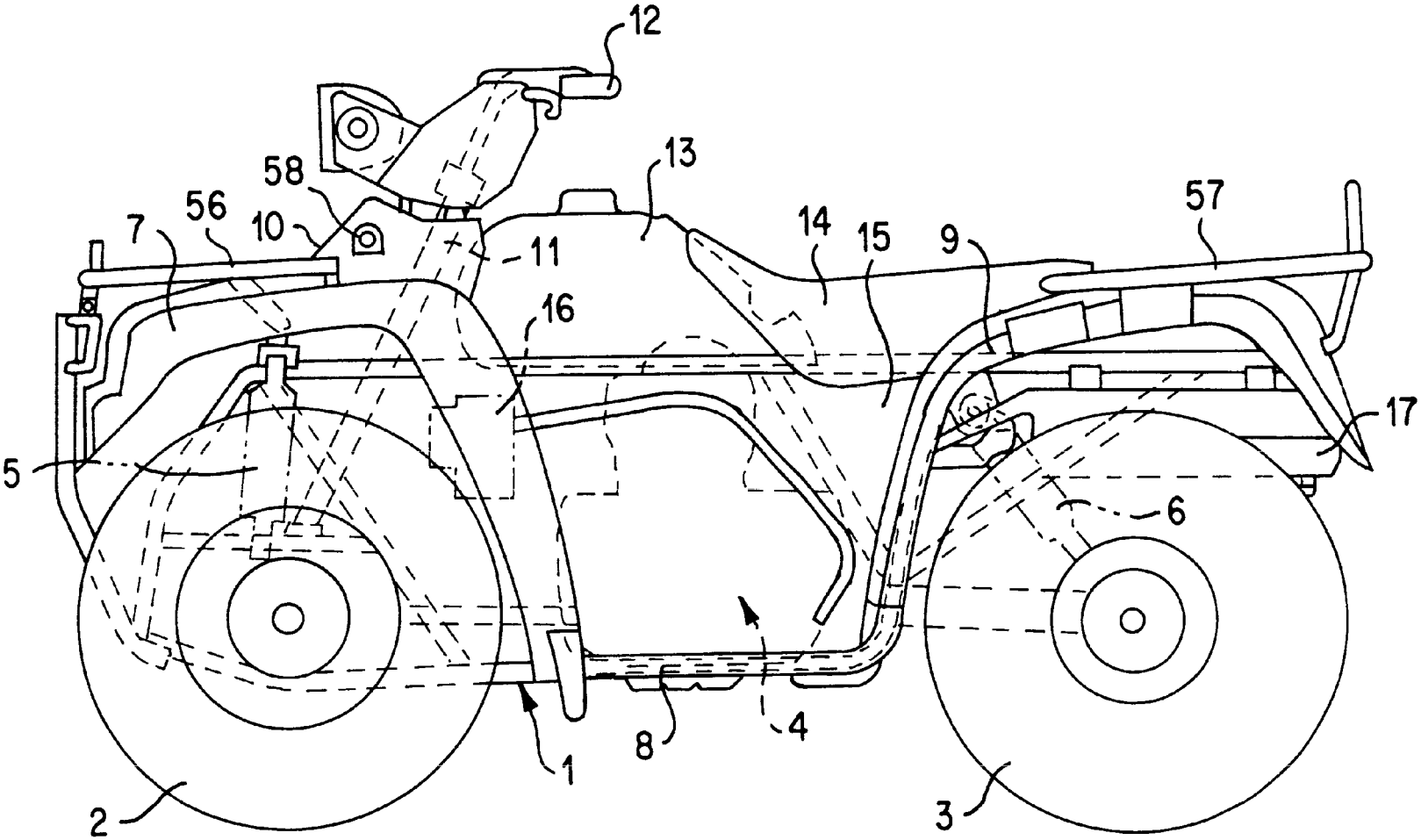
FIG. 2 is a side view of a four wheel vehicle.
Figure 3:
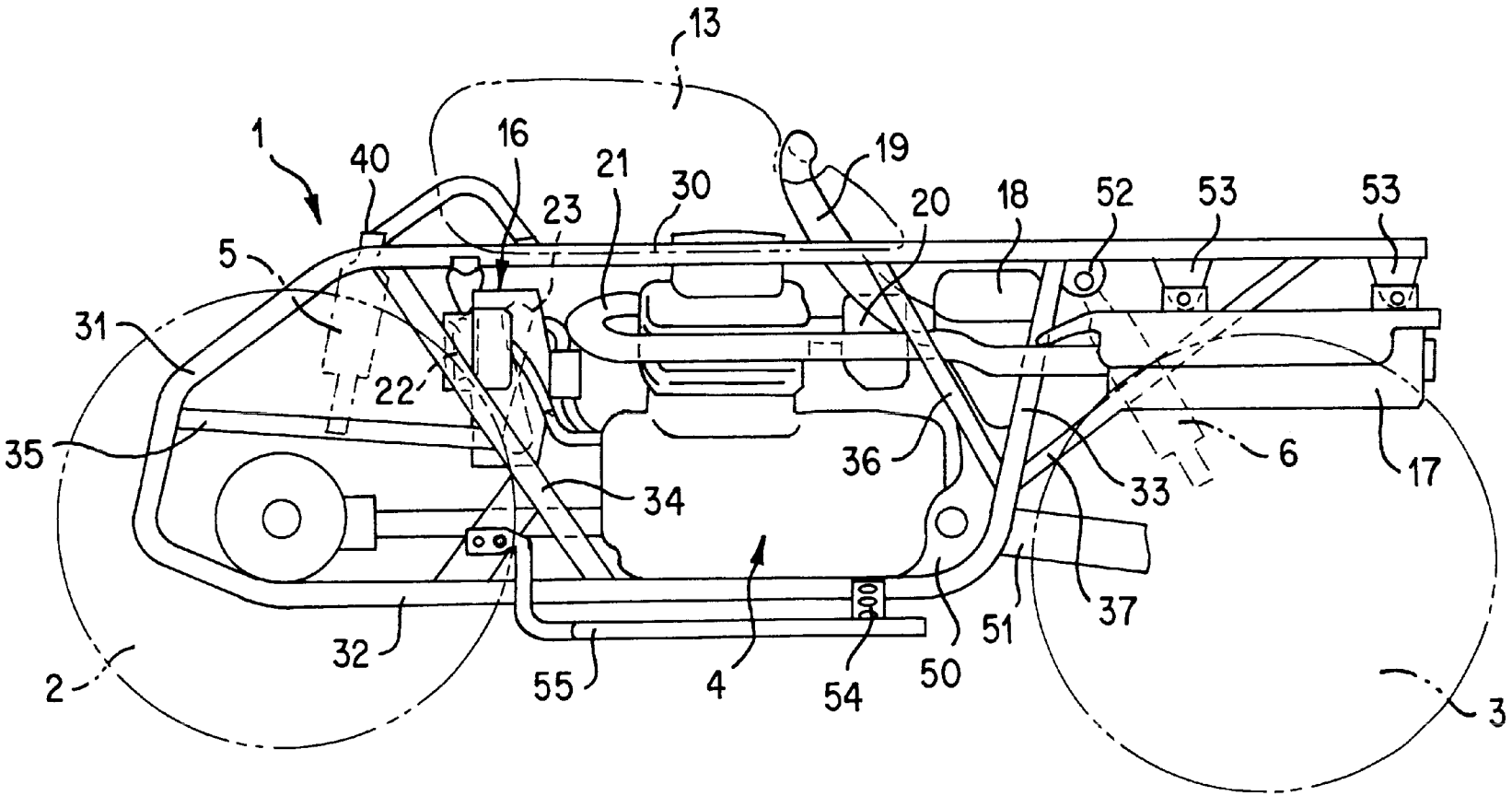
FIG. 3 is a side view of specific portions of the four wheel vehicle body.
Figure 4:
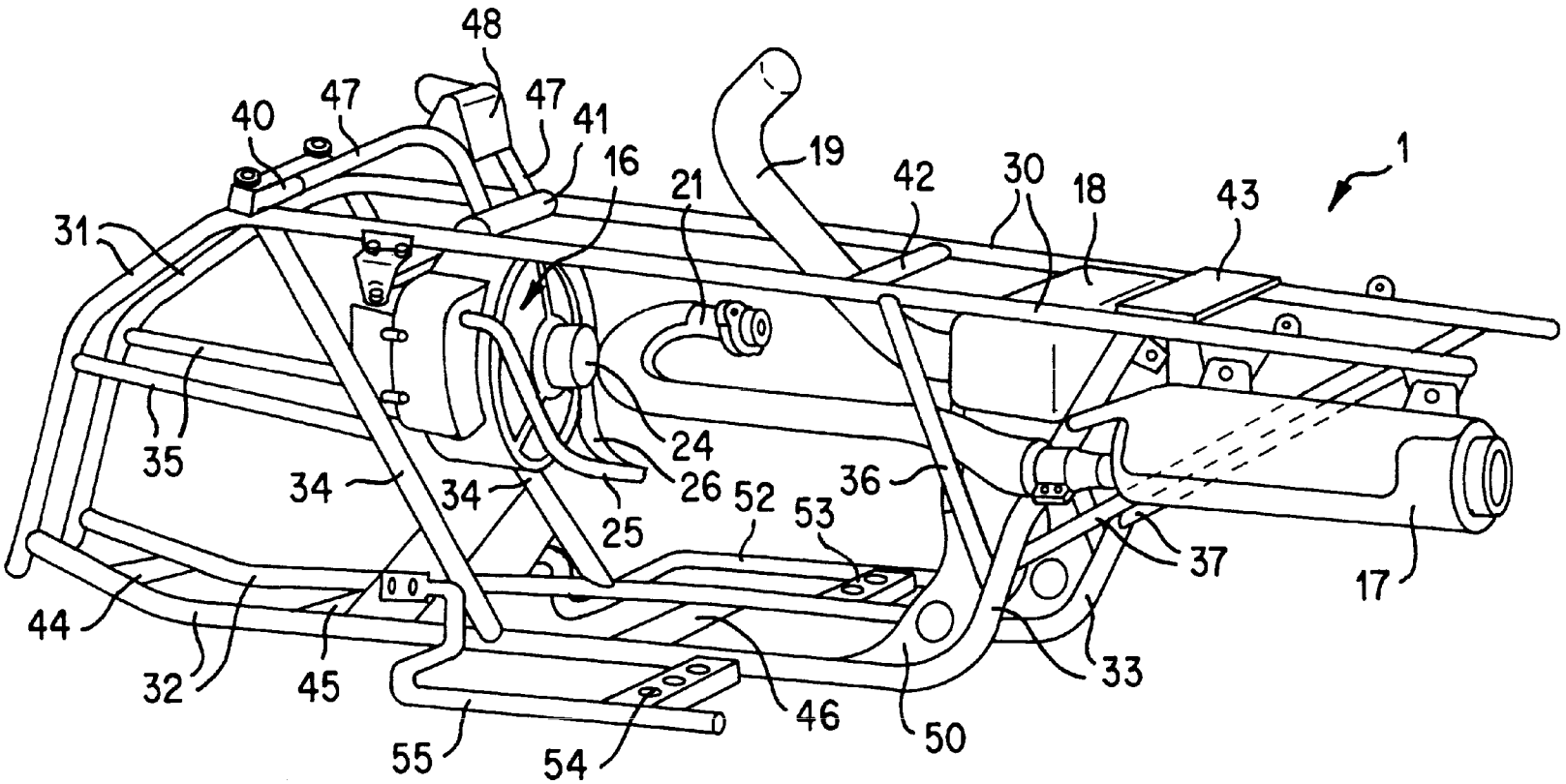
FIG. 4 is a perspective view of particular portions of the four wheel body.

FIG. 1 is a perspective view of a heat insulator according to an embodiment of the present invention; FIG. 2 is a side view of a four wheel vehicle; FIG. 3 is a side view of specific portions of the four wheel vehicle body; and FIG. 4 is a perspective view of particular portions of the four wheel body.

According to the buggy vehicle, pairs of front wheels 2 and rear wheels 3 comprising low pressure balloon tires are supported respectively on a left and right sides of a front and a rear portion of a vehicle body frame 1. The body frame 1 is driven by a power unit 4 mounted at a central portion of the vehicle body frame 1. The body frame 1 also includes a front cushion 5 and a rear cushion 6.

Reference numeral 7 in FIG. 2 designates a front fender, 8 designates a sub fender, and 9 designates a rear fender. Furthermore, 10 designates a front panel, 11 designates a steering shaft, 12 designates a handlebar, 13 designates a fuel tank, 14 designates a saddle riding type seat, 15 designates a rear panel, 16 designates a cooling unit and 17 designates a muffler. Additionally, reference numberal 18 in FIG. 3 designates an air cleaner, 19 designates a snorkel duct and 20 designates a carburetor.

Next, an explanation will be given of structure of the vehicle body frame 1. As shown by FIGS. 3 and. 4, the vehicle frame 1 is provided with respective left and right pairs of upper pipes 30 extended in a front and rear direction substantially in parallel with each other and in a linear shape. The vehicle frame 1 is also provided with front pipes 31 being extended in an up and down direction from front end portions thereof, lower pipes 32 being extended in a rear direction from lower end portions thereof and center pipes 33 extended in an upper direction from rear end portions thereof and connected to positions shifted rearward from middle portions of the upper pipe 30.

Moreover, the vehicle body frame 1 is provided with respective left and right pairs of reinforcement pipes 34 connected from front end portions of the upper pipes 30 to front half side portions of the lower pipes 32 in an oblique direction. Middle pipes 35 are connected to respective middle portions of the reinforcement pipes 34 and the front pipes 31 in the front and rear direction. The vehicle body frame also includes reinforcement pipes 36 and 37 which are connected to middle portions of the center pipes 33, and a cross member 40, cross pipes 41 and 42 and cross members 43, 44, 45, 46 and the like are respectively made to span left and right members of the vehicle body frame 1. Each of the described members constitute the vehicle body frame 1 and are connected and integrated together to form the vehicle shown in FIGS. 2–4.

The cross member 40 is provided between front end portions of the upper pipes 30 and is connected with the cross pipe 41, which is arranged on a rear side thereof. The cross member 40 and the cross pipe 41 are in parallel and are separated by head portion pipes 47 formed in a shape of a mountain in side view in the front and rear direction. An upper portion of the steering shaft 11 is rotatably supported by a stay 48 provided at top portions of the head portion pipes 47. A lower end portion of the steering shaft 11 is axially supported by a bearing portion provided at the middle pipes 35.

Furthermore, an upper end portion of the front cushion 5 is supported by both left and right ends of the cross member 40 and a lower end portion of the front cushion 5 is attached to upper arms constituting a front wheel suspension of a double wishbone type (not illustrated). The upper arms are pivotably supported by the middle pipes 35 and lower arms paired therewith are pivotably supported by front end portions of the lower pipes 32.

Pivot plates 50 are provided at corner portions of lower portions of the center pipes 33 and rear ends of the lower pipes 32 and front end portions of rear swing arms 51 are pivotably supported thereby. The rear swing arm 51 contains a drive shaft constituting a rear wheel drive mechanism. The upper pipes 30 are extended further rearward from portions thereof and are connected with the center pipes 33. An upper end portion of the rear cushion 6 is supported by stays 52, and the muffler 17 is supported by another stay 53.

An exhaust pipe 21, a rear end portion of which is connected to the muffler 17, is extended in the front direction substantially in a linear shape and a front end portion thereof is bent substantially in a U-like shape and is connected to an exhaust port provided at a cylinder head of the power unit 4. Furthermore, the cooling unit 16 is hung from and supported by the upper pipes 30 on a front side of the power unit 4. The cooling unit 16 is integrated with an oil cooler 22 and a cooling fan 23. Reference numeral 24 designates a motor thereof, and reference numerals 25 and 26 designate hoses connected to the power unit 4.

Furthermore, steps 54 extended to outer sides are provided at portions of the left and right lower pipes 32 for mounting the power unit 4. The steps 54 are protruded from the lower pipes 32 in outer side directions, step frames 55 are bent to connect front ends thereof and the lower pipes 32 and the sub fender 8 are mounted on and attached to these members (the sub fender 8 on the right side of the vehicle body is not illustrated).

Figure 5:
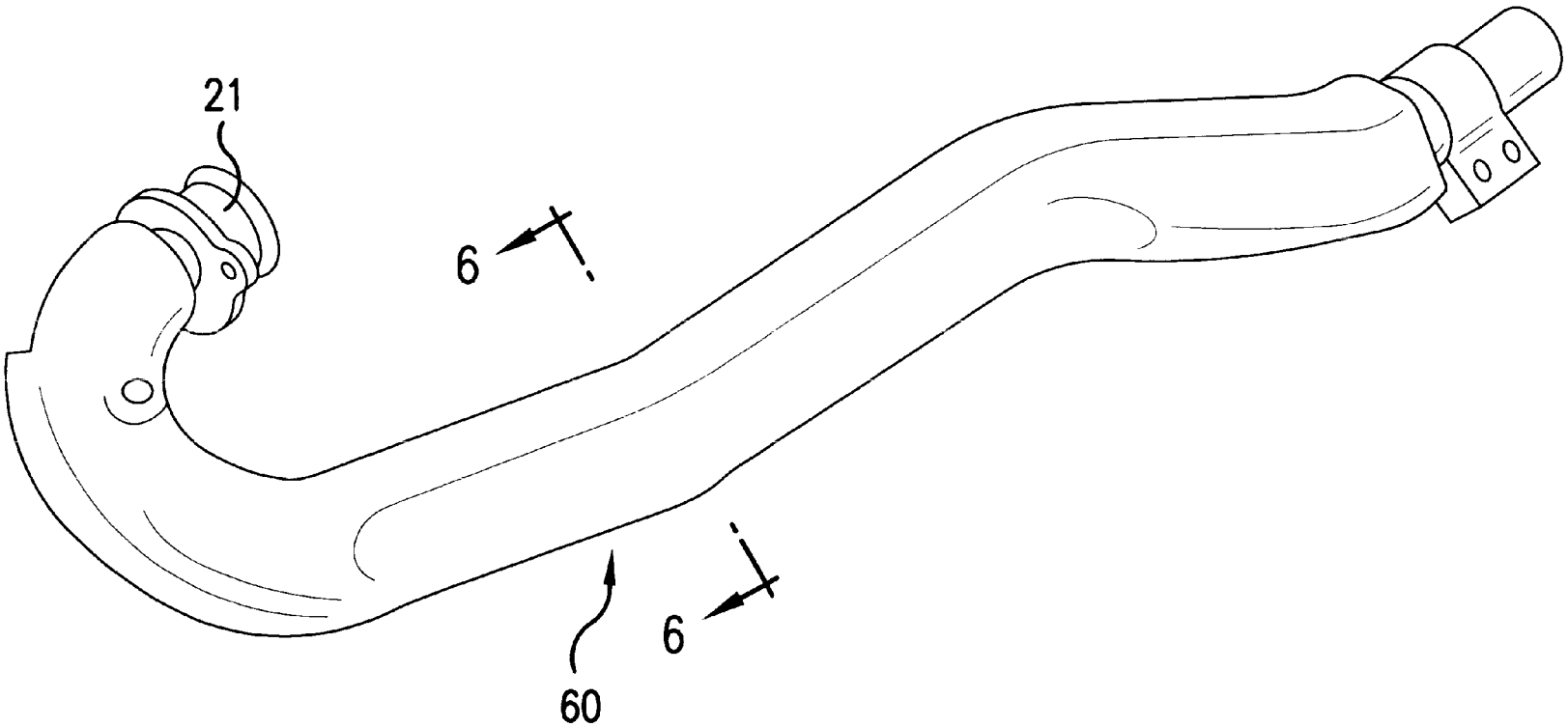
FIG. 5 is a perspective view of an exhaust pipe having a heat insulator attached thereto according to an embodiment of the present invention.
Figure 6:
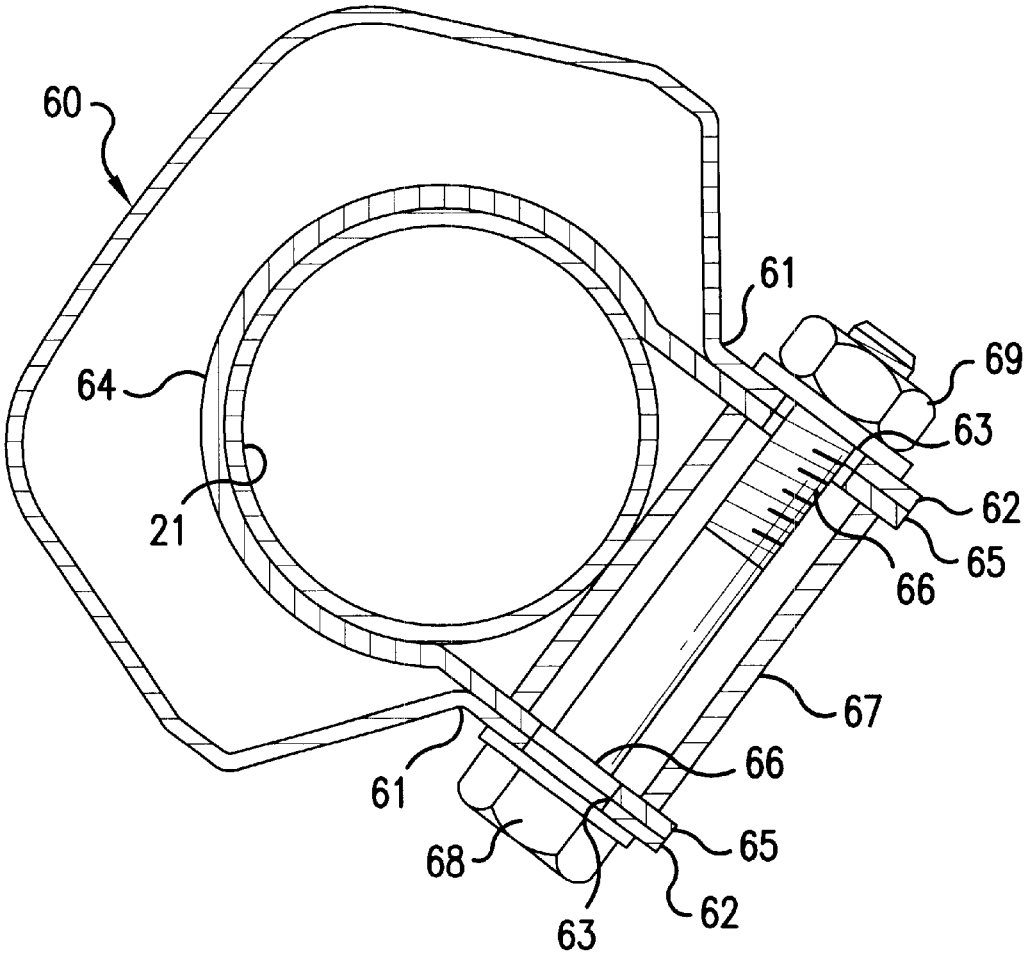
FIG. 6 is a cross-sectional view taken along a line 6—6 of FIG. 5.

Next, an explanation will be given of a heat shielding structure of an exhaust pipe according to the present invention. FIG. 1 is a drawing showing an exhaust pipe 21 in a state attached with a heat insulator 60 from inside of a vehicle body, FIG. 5 is a drawing showing the exhaust pipe 21 from an opposite side, that is, from outside of the vehicle body and FIG. 6 is a cross-sectional view taken along a line 6—6 of FIG. 5.

As shown by these drawings, the heat insulator 60 is constituted by a metal or the like having heat resistance and heat insulating performance to some degree. The heat insulator 60 covers an outer periphery of the exhaust pipe 21 in a range of about ¾ turn while maintaining a pertinent interval therebetween, and covers the exhaust pipe 21 substantially over an entire length thereof (refer to FIG. 1 and FIG. 6).

A pair of edge portions 61 of the heat insulator 60 along a length direction thereof, is integrally formed with attaching portions 62 to be opposed to each other at pertinent intervals in the length direction thereof. The attaching portions 62 are formed with through holes 63. Band-like members 64 are interposed between the heat insulator 60 and the exhaust pipe 21 on inner sides of positions of the heat insulator 60 provided with the attaching portions 62 (see FIG. 6).

The band-like member 64 is the member comparatively rich in elasticity in a strip-like shape comprising a pertinent material of a leaf spring or the like made of a metal. The band-link member 64 is similarly made to wrap around the outer peripheral portion of the exhaust pipe 21 in the range of about a ¾ turn, and both end portions 65 thereof in the length direction of the band-like member 64 are bent to overlap the attaching portions 62 of the edge portions opposed thereto and formed with through holes 66 coinciding with the through holes 63.

Collars 67 are arranged between the left and right through holes 66 and when the through holes 63, the through holes 66 and the collars 67 are coaxially arranged, bolts 68 are inserted therethrough from the through holes 63 on one side and fastened with nuts 69 on other side. Therefore, the heat insulator 60 is attached to the exhaust pipe 21 via the band-like members 64.

That is, by fastening the left and right both end portions 65 in the length direction by the bolts 68 and the nuts 69 while interposing the collars 67 therebetween, the band-like members 64 are fixed in a state in which the band-like members 64 are made to overlap the outer periphery of the exhaust pipe 21.

At the same time, the left and right attaching portions 62 are brought into close contact with and integrated to the left and right both end portions 65 in the length direction by the bolts 68 and the nuts 69 and accordingly, the heat insulator 60 is attached to the outer periphery of the exhaust pipe 21 while maintaining a predetermined interval therebetween.

Figure 7:
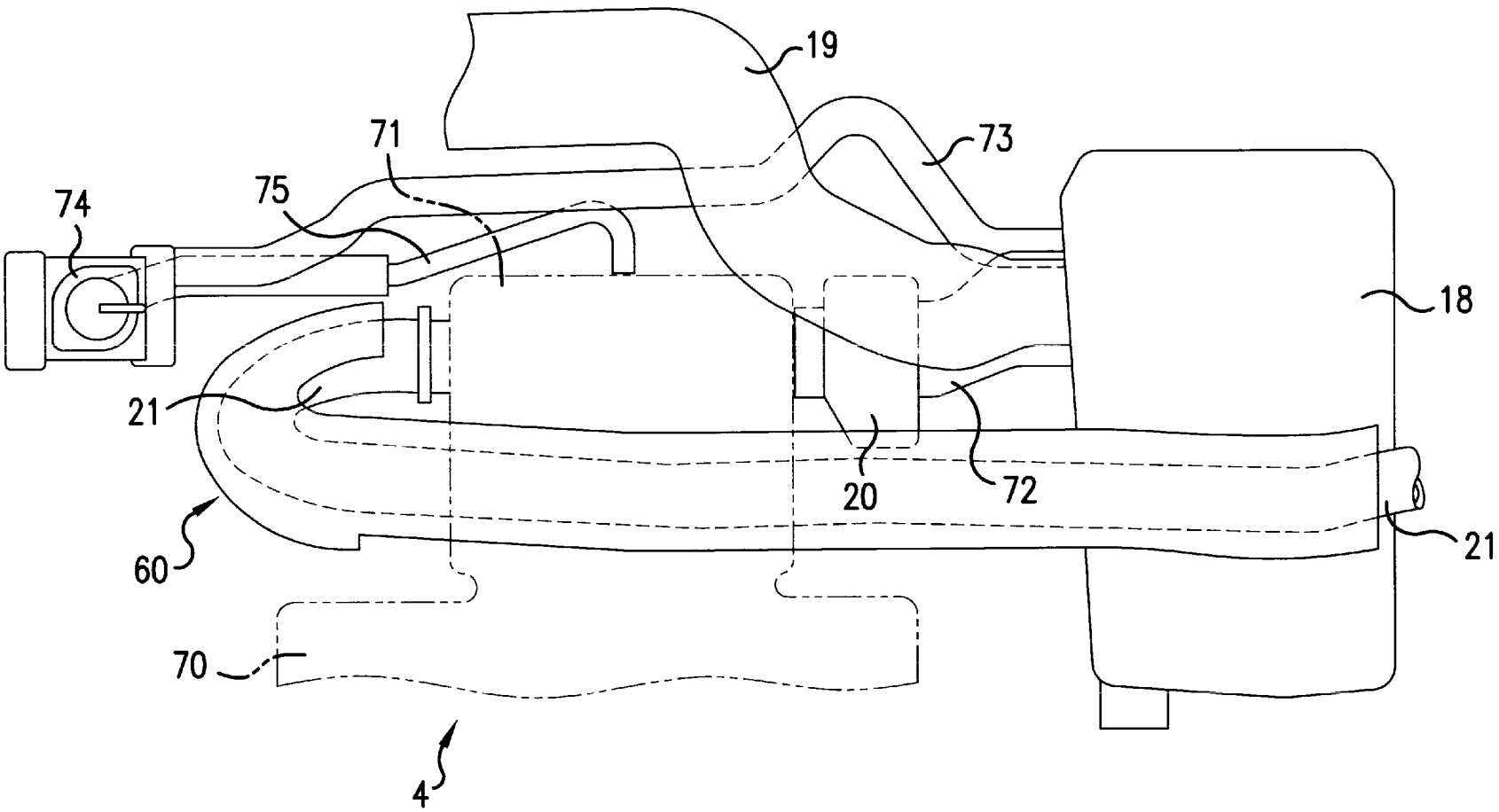
FIG. 7 is a side view illustrating an arrangement of an exhaust pipe and portions of an intake system according to an embodiment of the present invention.
Figure 8:
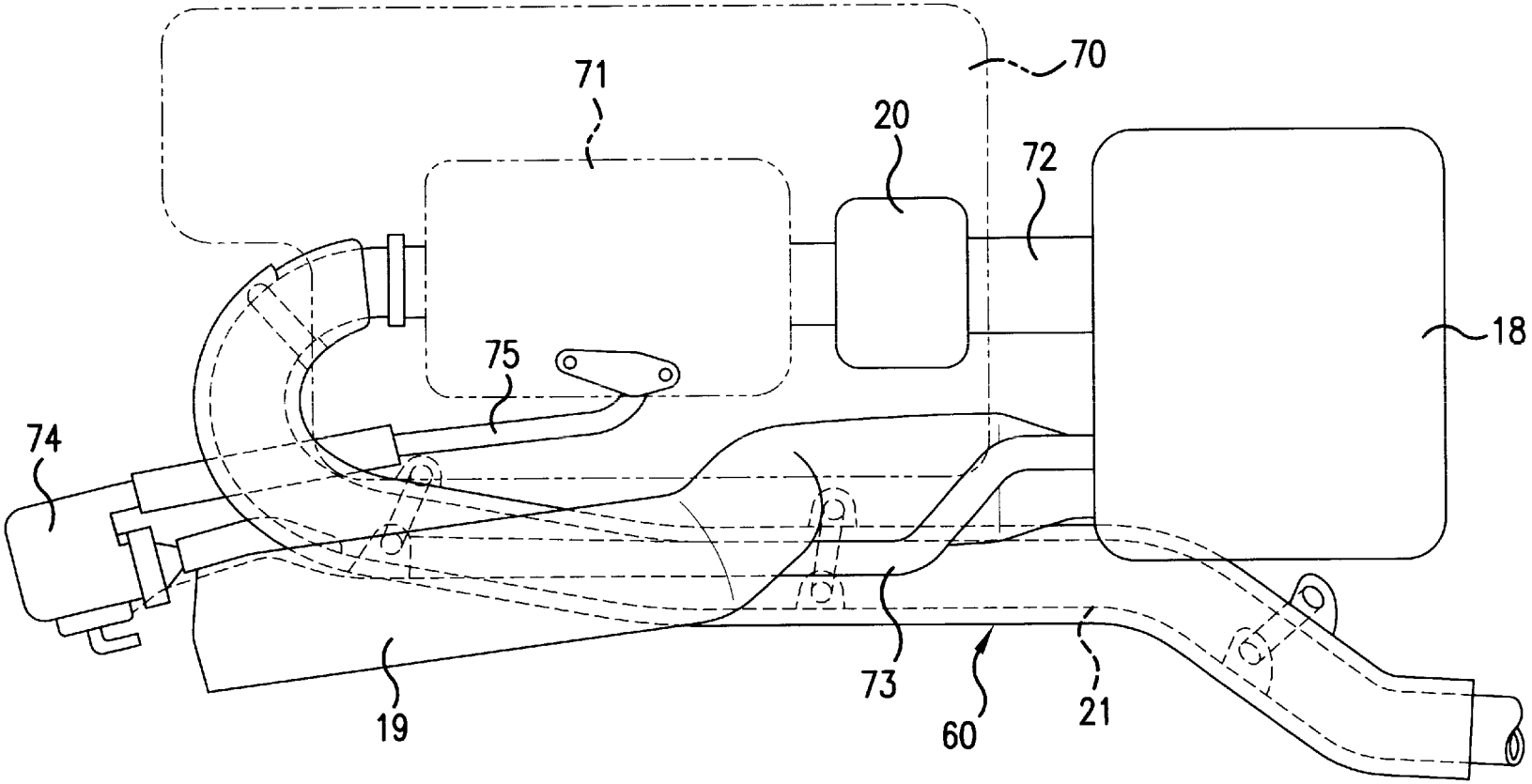
FIG. 8 is a plan view illustrating an arrangement of an exhaust pipe and portions of an intake system according to an embodiment of the present invention.

Next, an explanation will be given of a structure of arranging exhaust pipe 21 and parts of an intake system. FIG. 7 is a drawing illustrating an arrangement of these parts from a side of the vehicle body and FIG. 8 is a drawing illustrating the arrangement from a plan view.

As illustrated by these drawings, the exhaust pipe 21 passes above a crank case 70 constituting the power unit 4 substantially linearly in the front and rear direction and a front end portion thereof is connected to an exhaust port provided at a cylinder head 71 of the power unit 4.

A rear portion of the exhaust pipe 21 partially overlaps a side portion of the air cleaner 18 and thereafter is bent to an outer side and connected to the muffler 17. On the upper side of the exhaust pipe 21, a connecting tube 72 is extended in the rear direction from an intake port of the cylinder head 71 via the carburetor 20 and is connected to substantially a central portion of a front face of the air cleaner 18.

A rear end of the snorkel type duct 19 is connected to the front face of the air cleaner 18 side by side with the connecting tube 72 and a connecting portion thereof is deviated to the side of the exhaust pipe 21. The snorkel type duct 19 is extended to a front side of the cylinder head 71 above the exhaust pipe 21, and a front end portion thereof is opened in a side direction to overlap a rear face of the fuel tank 13, which is disposed at a position higher than the muffler 17 and can intake air even when the lower portion of the vehicle body is sunk in water.

Moreover, there is arranged a blowby gas returning hose 73 from a vicinity of the connecting portion of the snorkel type duct 19 connected to the front face of the air cleaner 18 in the front and rear direction substantially side by side with the snorkel duct 19 respectively, and a front end portion thereof is connected to a valve 74 on the front side of the cylinder head 71. A blowby gas flow-in hose 75 is extended from the valve 74 in the rear direction and connected to the cylinder head 71.

The snorkel type duct 19 and the blowby gas returning hose 73 are arranged to substantially overlap the exhaust pipe 21 in a range of from the air cleaner 18 to the cylinder head 71. Moreover, an opening portion formed between the pair of edge portions 61 along the length direction of the heat insulator 60 is directed to the inner side of the vehicle body in an oblique lower direction.

Therefore, although the exhaust pipe 21 is arranged such that radiation heat thereof is liable to effect thermal influence directly on the parts of the intake system such as the air cleaner 18 and the snorkel type duct 19 and the blowby gas returning hose 73 or the like, the concern of the thermal influence can be reduced by the heat insulator 60.

That is, the rear portion of the heat insulator 60 overlaps substantially the side face of the air cleaner 18, and the front end portion covers substantially the entire length of the exhaust pipe 21 extended to a vicinity of the exhaust port. An opening portion formed between the pair of edge portions 61 of the heat insulator 60 is directed to the inner side of the vehicle body and in the oblique lowered direction; therefore, the radiation heat of the exhaust pipe 21 is prevented from directly influencing various parts of the intake system such as the air cleaner 18, the snorkel type duct 19 and the like and the blowby gas returning hose 73 or the like by the heat insulator 60.

Next, an explanation will be given of operation of an embodiment according to the present invention. When the band-like members 64 are made to overlap the outer periphery of the exhaust pipe 21, the heat insulator 60 is made to cover the band-like members 64 from outer sides thereof. The both end portions 65 of the band-like members 64 in the length direction and the pairs of attaching portions 62 provided at the pairs of edge portions 61 of the heat insulator 60 along the length direction of the exhaust pipe 21, are made to overlap each other, the through holes 66 and 63 respectively formed thereto are made to coincide with each other and the heat insulator 60, the heat insulator 60 and the band-like members 64 are fastened together by the bolts 68 and the nuts 69. The collars 67 are interposed between the both end portions 65 of the band-like members 64 in the length direction, thereby, the heat insulator 60 can be integrated to the exhaust pipe 21 easily and firmly.

Accordingly, there is no need to weld the attaching members to the heat insulator 60 and the exhaust pipe 21 as in the conventional structure. The band-like members 64 are separate from the heat insulator 60 and the exhaust pipe 21 until the attaching operation and therefore, the conventional welding process is dispensed with. The number of fabrication steps of the heat insulator 60 and the exhaust pipe 21 are respectively reduced to thereby reduce manufacturing steps and increase cost saving during the manufacturing process. Furthermore, by using the interposing collars 67, the attaching operation can be carried out easily even when there is deviation in the accuracy of dimensions between the attaching portions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claim.

What is claimed is:

1. A shielding structure for an exhaust system, comprising:

at least one elastic member for attaching to at least a portion of an outer periphery of an exhaust member, said at least one elastic member comprising an elongate strip having first and second end portions, each of said first and second end portions having a through-hole extending therethrough;

a heat insulator for covering at least a portion of said elastic member and at least a portion of the outer periphery of the exhaust member, said heat insulator having first and second opposing edges which coincide with each other, said heat insulator including first and second attaching portions integrally formed with and extending from said first and second opposing edges, respectively, each of said first and second attaching portions having a through-hole extending therethrough, said first and second attaching portions of said heat insulator overlying said first and second end portions of said at least one elastic member such that all of said through-holes are aligned with one another;

an elongated tubular collar interposed between said first and second end portions of said elongate strip;

a bolt extending through all of said through-holes and through said collar; and a nut secured to one end of said bolt, wherein said heat insulator is connected to said at least one elastic member to thereby remain functionally positioned on the exhaust member.

2. The shielding structure according to claim 1, wherein said at least one elastic member encompasses at least three-fourths of the outer periphery of the exhaust member.

3. The shielding structure according to claim 1, wherein said heat insulator covers at least three-fourths of said at least one elastic member and the exhaust member.

4. The shielding structure according to claim 1, wherein a portion of said heat insulator is spaced a predetermined interval from said at least one elastic member and the exhaust member.

5. The shielding structure according to claim 1, wherein a surface of said at least one elastic member abuts directly with a surface of the outer periphery of the exhaust pipe.

6. The shielding structure according to claim 1, wherein said at least one elastic member is a plurality of elastic members, wherein each of said plurality of elastic members is spaced a predetermined interval from an adjacent elastic member.

7. The shielding structure according to claim 6, wherein said heat insulator is connected to each of the elastic members.

8. The shielding structure according to claim 1, wherein said collar is cylindrical.

9. The shielding structure according to claim 1, wherein said collar has a length approximately equal to a diameter of the exhaust member.

10. The shielding structure according to claim 1, wherein said collar is not directly fixed to the exhaust member.

* * * * *